US007823936B2

(12) United States Patent
Compeau

(10) Patent No.: US 7,823,936 B2
(45) Date of Patent: Nov. 2, 2010

(54) VENDING MACHINE LOCK

(75) Inventor: David Edward Compeau, Oxford, MI (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 424 days.

(21) Appl. No.: 10/571,436

(22) PCT Filed: Sep. 13, 2004

(86) PCT No.: PCT/US2004/029785

§ 371 (c)(1),
(2), (4) Date: Mar. 13, 2006

(87) PCT Pub. No.: WO2005/026475

PCT Pub. Date: Mar. 24, 2005

(65) Prior Publication Data

US 2007/0024062 A1 Feb. 1, 2007

(51) Int. Cl.
*E05C 3/06* (2006.01)

(52) U.S. Cl. ..... 292/201; 292/216; 292/DIG. 62

(58) Field of Classification Search ..... 292/201, 292/216, 199, DIG. 62, 279, 280; 49/280; 221/19, 154; 312/215, 222
See application file for complete search history.

(56) References Cited

U.S. PATENT DOCUMENTS

| | | | |
|---|---|---|---|
| 2,741,503 | A | 4/1956 | Thompson |
| 2,783,617 | A | 3/1957 | Halovatch |
| 2,814,324 | A | 11/1957 | Shur |
| 2,896,496 | A | 7/1959 | Jansen |
| 3,089,330 | A | 5/1963 | Kerr |
| 3,151,652 | A | 10/1964 | Zahodiakin |
| 3,157,215 | A | 11/1964 | Zahodiakin |
| 3,352,341 | A | 11/1967 | Schertz |
| 3,550,412 | A | 12/1970 | Pitel et al. |
| 3,695,139 | A | 10/1972 | Howe |
| 3,751,086 | A | 8/1973 | Geringer |
| 3,835,678 | A | 9/1974 | Meyer et al. |
| 4,067,477 | A | 1/1978 | Chalabian |
| 4,071,271 | A | 1/1978 | Bourrie et al. |
| 4,083,393 | A | 4/1978 | Okada |
| 4,167,104 | A | 9/1979 | Bond |
| 4,171,752 | A | 10/1979 | Pertinen |
| 4,175,989 | A | 11/1979 | Pospischil et al. |
| 4,185,730 | A | 1/1980 | Roes et al. |
| 4,220,024 | A | 9/1980 | Berich |

(Continued)

FOREIGN PATENT DOCUMENTS

| | | |
|---|---|---|
| CA | 799686 | 11/1998 |

(Continued)

OTHER PUBLICATIONS

"What is ZipTechnology™?," ZipNut.com, Thread Technology, Inc., 2000.

(Continued)

*Primary Examiner*—Peter M. Cuomo
*Assistant Examiner*—Mark Williams
(74) *Attorney, Agent, or Firm*—Baker & Daniels LLP

(57) ABSTRACT

A vending machine (10) is provided for storing items. The vending machine (10) includes a lock (18) to control access to the interior of the vending machine (10).

13 Claims, 7 Drawing Sheets

U.S. PATENT DOCUMENTS 4,232,798 A 11/1980 Hammel et al.
4,268,076 A 5/1981 Itoi
4,299,520 A 11/1981 Iwata
4,350,032 A 9/1982 Kochackis
4,378,187 A 3/1983 Fullerton
4,473,172 A 9/1984 Reynolds
4,568,998 A 2/1986 Kristy
4,589,571 A 5/1986 Sykes
4,594,637 A 6/1986 Falk
4,618,300 A 10/1986 Goebel
4,633,687 A 1/1987 Fane
4,667,990 A 5/1987 Quantz
4,741,454 A 5/1988 Ray et al.
4,746,153 A 5/1988 Compeau et al.
4,764,071 A 8/1988 Lawrence et al.
4,796,932 A 1/1989 Tame
4,974,888 A 12/1990 Childers
4,986,099 A 1/1991 Johnson et al.
4,993,247 A 2/1991 Minemura
5,007,261 A 4/1991 Quantz
5,027,630 A 7/1991 Stillwagon et al.
5,050,413 A 9/1991 Stillwagon et al.
5,127,508 A 7/1992 Teague
5,131,038 A 7/1992 Puhl et al.
5,143,430 A 9/1992 Craven et al.
5,148,691 A * 9/1992 Wallden ..... 70/279.1
5,160,180 A 11/1992 Mlynarczyk
5,197,314 A 3/1993 Stillwagon et al.
5,216,907 A 6/1993 Ullmann
5,269,161 A 12/1993 Stillwagon
5,273,183 A 12/1993 Tuttobene
5,324,150 A 6/1994 Fullerton
5,335,818 A 8/1994 Maldanis et al.
5,373,718 A 12/1994 Schwerdt et al.
5,378,100 A 1/1995 Fullerton
5,392,953 A 2/1995 Maldanis et al.
5,411,302 A 5/1995 Shimada
5,427,488 A 6/1995 Fullerton et al.
5,429,400 A 7/1995 Kawaguchi et al.
5,437,173 A 8/1995 Spinar
5,467,619 A 11/1995 Stillwagon et al.
5,476,190 A 12/1995 Herrmann et al.
5,491,471 A 2/1996 Stobbe
5,497,905 A 3/1996 Vogelpohl et al.
5,548,982 A 8/1996 Rawling
5,575,515 A * 11/1996 Iwamoto et al. ..... 292/341.17
5,580,200 A 12/1996 Fullerton
5,613,816 A 3/1997 Cabahug
5,636,881 A 6/1997 Stillwagon
5,647,471 A 7/1997 Ra
5,733,084 A 3/1998 Fullerton
5,774,059 A 6/1998 Henry et al.
5,788,443 A 8/1998 Cabahug
5,791,179 A 8/1998 Brask
5,799,822 A 9/1998 Rudewicz et al.
5,800,108 A 9/1998 Cabahug
5,813,257 A 9/1998 Claghorn et al.
5,823,027 A 10/1998 Glick et al.
5,845,524 A 12/1998 Koehler
5,848,541 A 12/1998 Glick et al.
5,862,693 A 1/1999 Myers et al.
5,921,119 A 7/1999 Myers et al.
5,936,544 A 8/1999 Gonzales et al.
5,975,348 A 11/1999 Rudewicz et al.
6,038,892 A 3/2000 Schmitt
6,046,681 A 4/2000 Solop
6,050,447 A 4/2000 Kovens et al.
6,068,305 A * 5/2000 Myers et al. ..... 292/201
6,076,868 A * 6/2000 Roger et al. ..... 292/201
6,082,153 A 7/2000 Schoell et al.
6,129,238 A 10/2000 Rumminger
6,216,980 B1 4/2001 Baudu et al.
6,345,522 B1 2/2002 Stillwagon et al.
6,351,977 B1 3/2002 Pedroso et al.
6,496,101 B1 12/2002 Stillwagon
6,520,548 B1 2/2003 Fisher et al.
6,525,644 B1 2/2003 Stillwagon
6,550,825 B2 4/2003 Ostrowski et al.
6,575,504 B2 6/2003 Roatis et al.
6,581,986 B2 6/2003 Roatis et al.
6,684,671 B2 2/2004 Beylotte et al.
6,867,685 B1 3/2005 Stillwagon
6,874,828 B2 4/2005 Roatis et al.
6,886,869 B2 * 5/2005 Martinez et al. ..... 292/216
2004/0113438 A1 * 6/2004 Kachouh ..... 292/201
2004/0154363 A1 8/2004 Beylotte et al.
2004/0172991 A1 9/2004 Forster et al.

FOREIGN PATENT DOCUMENTS

JP 403100283 4/1991
WO PCT/US01/46272 5/2002

OTHER PUBLICATIONS

"How does it work?," ZipNut.com, Thread Technology, Inc., 2000.

* cited by examiner

VENDING MACHINE LOCK

BACKGROUND OF THE INVENTION

This application claims benefit of U.S. Provisional Application Ser. No. 60/502,041, filed Sep. 11, 2003, titled Vending Machine Lock, the disclosure of which is expressly incorporated by reference herein. This application relates to subject matter disclosed in U.S. patent application Ser. No. 10/000,203, entitled "Vending Machine Lock," filed Nov. 2, 2001, which claims benefit to U.S. Provisional Patent Application Ser. No. 60/245,352, entitled "Lock," filed Nov. 2, 2000, to Beylotte et al.; and U.S. Provisional Patent Application Ser. No. 60/276,546, entitled "Lock," filed on Mar. 16, 2001 to Beylotte et al., the disclosures of which are expressly incorporated by reference herein.

The present invention relates to a lock. More particularly, the present invention relates to locks used on vending machines.

According to the present invention, a vending machine is provided including one or more of the following features:

a) a lock including a first interactive member, such as a looped rod, a second interactive member, such as an arm of a C-shaped lock member, that couples with the first interactive member, a motor that drives the C-shaped lock member, and a lost-motion mechanism positioned between the C-shaped lock member and the motor;

b) a ratchet mechanism positioned between a lock member and a motor; and/or d) a torque converter, such as a gear set, including a lost-motion mechanism positioned between a lock member and a motor.

According to another aspect of the present invention, a vending machine is provided that is configured to retain objects for distribution. The vending machine includes a cabinet defining an interior region sized to receive the objects for distribution, a door, and a lock. The door is coupled to the cabinet to move between an opened position permitting access to the interior region of the cabinet and a closed position blocking access to the interior region of the cabinet. At least one of the cabinet and door have an opening sized to permit distribution of the objects while the door is in the closed position. The lock is configured to move between a locked position blocking movement of the door from the closed position and an unlocked position permitting movement of the door from the closed position. The lock includes a lock member, a motor configured to power movement of the lock member, and a ratchet mechanism positioned between a lock member and a motor to transfer force from the motor to the lock member.

According to another aspect of the present invention, a vending machine is provided that is configured to retain objects for distribution. The vending machine includes a cabinet defining an interior region sized to receive the objects for distribution, a door, and a lock. The door is coupled to the cabinet to move between an opened position permitting access to the interior region of the cabinet and a closed position blocking access to the interior region of the cabinet. At least one of the cabinet and door have an opening sized to permit distribution of the objects while the door is in the closed position. The lock is configured to move between a locked position blocking movement of the door from the closed position and an unlocked position permitting movement of the door from the closed position. The lock includes a lock member, a motor configured to power movement of the lock member, and a lost-motion mechanism including first and second interactive members transferring force from the motor to the lock member. The first and second interactive members have rotational movement therebetween during movement of the door of the cabinet to the closed position.

According to another aspect of the present invention, a vending machine is provided that is configured to retain objects for distribution. The vending machine includes a cabinet defining an interior region sized to receive the objects for distribution, a door, and a lock. The door is coupled to the cabinet to move between an opened position permitting access to the interior region of the cabinet and a closed position blocking access to the interior region of the cabinet. At least one of the cabinet and door have an opening sized to permit distribution of the objects while the door is in the closed position. The lock is configured to move between a locked position blocking movement of the door from the closed position and an unlocked position permitting movement of the door from the closed position. The lock includes a lock member, a motor configured to power movement of the lock member, and worm gear set transferring force from the motor to the lock member.

Additional features of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
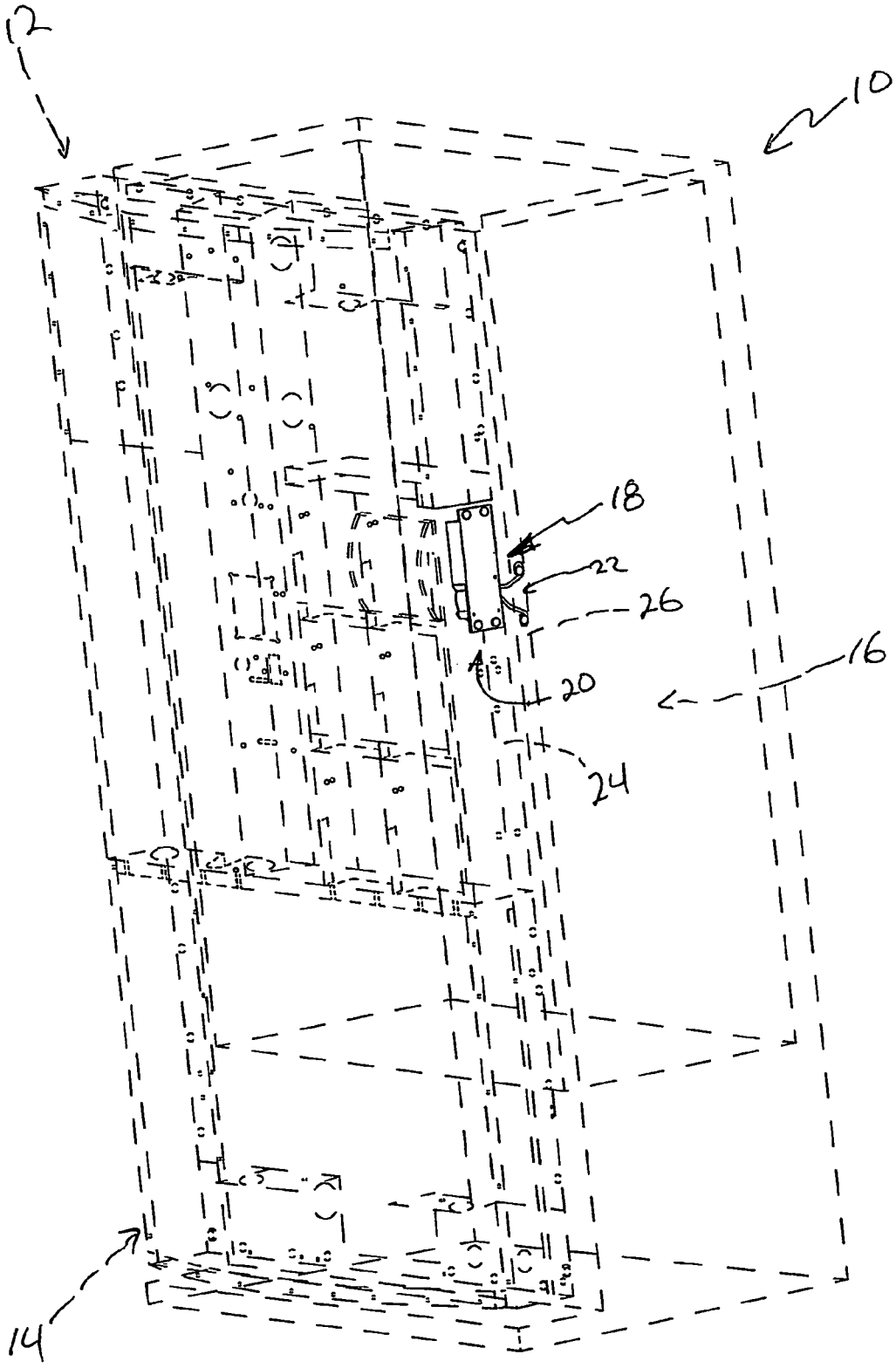
FIG. 1 is a perspective view of a vending machine showing the vending machine including a cabinet (in phantom) and a lock (in solid)

A vending machine 10 is shown in FIG. 1. Vending machine 10 includes a housing or cabinet 12 and a closure or door 14 that opens and closes relative to cabinet 12. Cabinet 12 and door 14 define a chamber or interior region 16 in which items such as beverages and food may be stored. A seal (not shown) is compressed between cabinet 12 and/or door 14 to seal vending machine 10 when door 14 is closed relative to cabinet 12. Many of the items stored in vending machine 10 must be refrigerated and the seal assists in maintaining the refrigerated state of vending machine 10.

A lock 18 is provided that blocks movement of door 14 from a closed position to an opened position. Lock 18 includes a first portion or lock mechanism 20 and a second portion or bent rod 22 that are coupled to door 14 and cabinet 12, respectively, as shown in FIG. 1.

Figure 2:
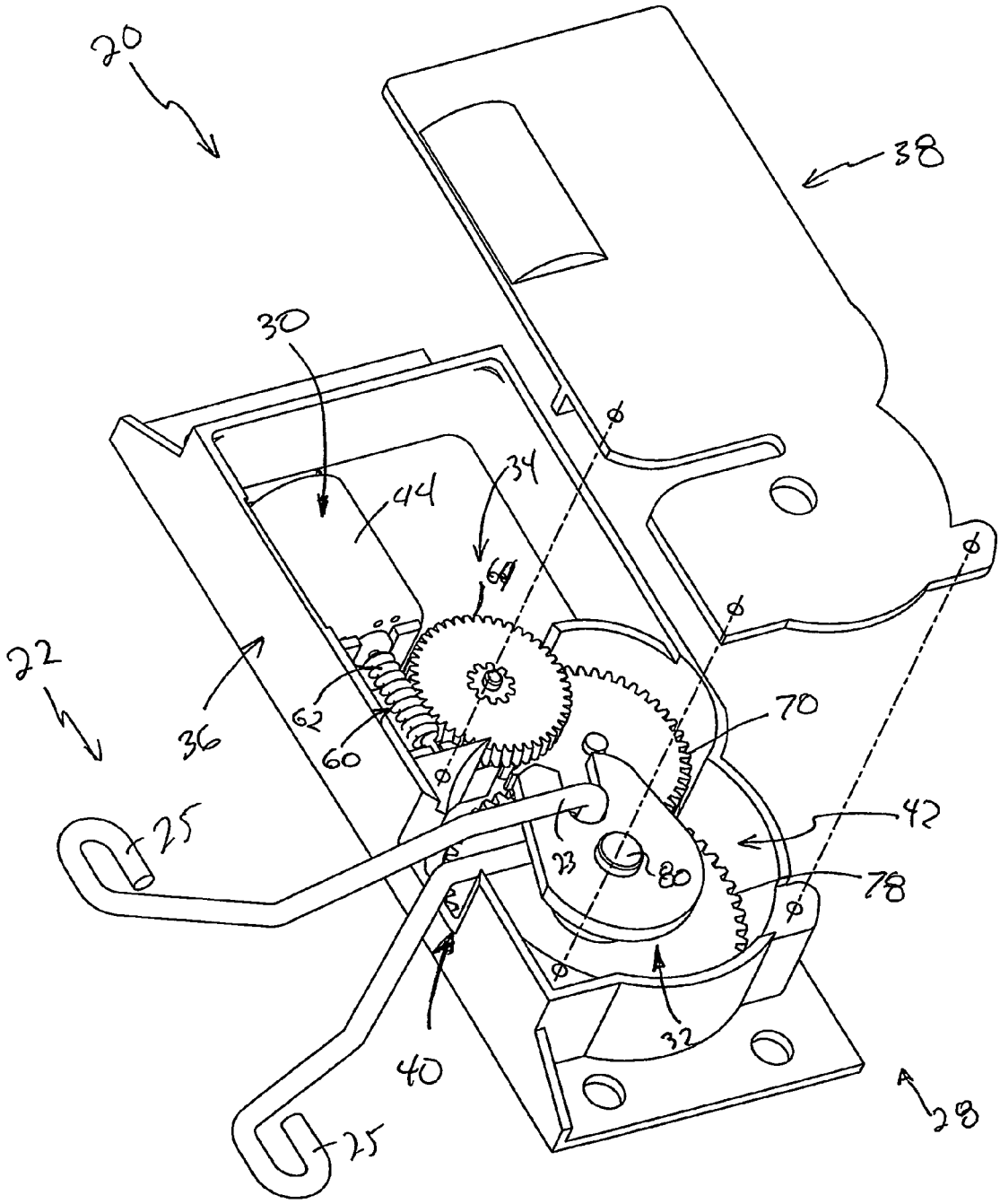
FIG. 2 is a perspective view of the lock of FIG. 1 showing the lock including a bent rod and a lock mechanism coupled with the rod and including a housing, a C-shaped lock member coupled with the rod, a gear set, and a motor positioned to drive the gear set.

Door 14 includes a front cover or shroud (not shown) and a perimeter sidewall 24. As shown in FIG. 1, first portion 20 of lock 18 is coupled to perimeter sidewall 24 of door 14. Rod 22 includes a looped portion or first interactive member 23 and a pair of hooks 25 as shown in FIG. 2. Cabinet 12 includes sidewalls 26 and hooks 25 of rod 22 are coupled to one of sidewalls 26 by bolts (not shown) as shown in FIG. 1. According to alternative embodiments of the present disclosure, the lock mechanism is coupled to the cabinet and the rod is coupled to the door.

Lock mechanism 20 and rod 22 of lock 18 are positioned relative to door 14 and cabinet 12, respectively, so that lock mechanism 20 and looped portion 23 of rod 22 interact with each other to secure and seal door 14 to cabinet 12. In addition, lock mechanism 20 and rod 22 are coupled to vending machine 10 so that entire lock 18 is positioned within interior region 16 of vending machine 10 so that no portion of lock 18 is visible to an individual looking at the outside of vending machine 10.

As shown in FIG. 2, lock mechanism 20 of lock 18 includes a housing 28, an IR receiver or sensor (not shown), controls (not shown), an electric lock member mover or motor 30, a C-shaped disk or lock member 32, and a torque converter or gear set 34 positioned between motor 30 and lock member 32. Preferably, an authorized user presents a token, key fob, or other transmitter that sends an IR signal to the IR receiver. The controls then determine whether the user is authorized to access vending machine 10.

According to alternative embodiments of the present disclosure, other techniques of remote communication or frequencies of remote communication are used, such as RF signals using an antenna or other frequencies known to those of ordinary skill in the art. Additional disclosure of a suitable antenna assembly and controls is provided in U.S. patent application Ser. No. 10/000,203, the disclosure of which is expressly incorporated by reference herein. According to another alternative embodiments, non-remote access is provided using a keypad, mechanical key, or other non-remote access devices known to those of ordinary skill in the art.

Figure 3:
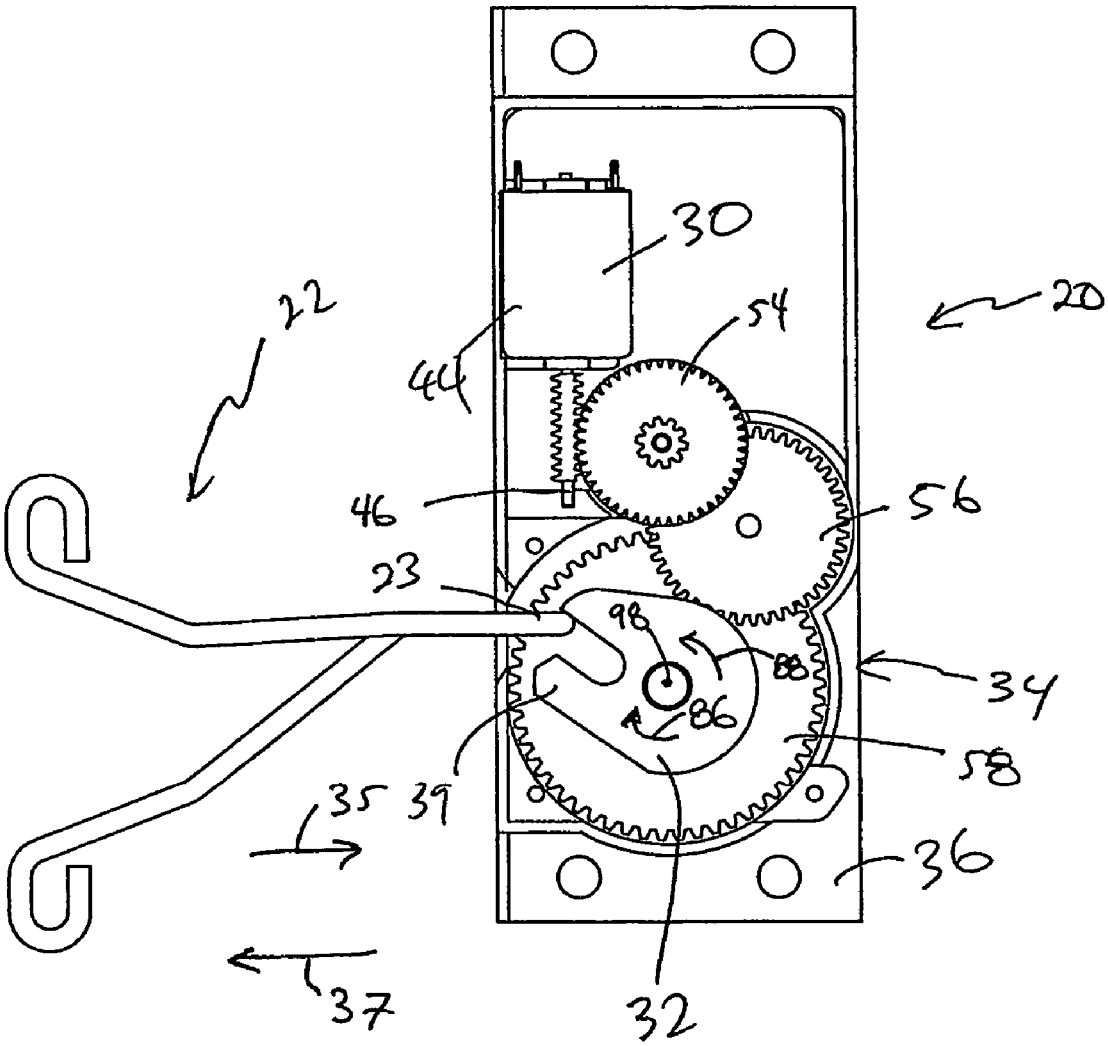
FIG. 3 is top plan view of the lock showing the rod in an unlocked position relative to the C-shaped lock member.

When in an unlocked position, shown in FIG. 3, rod 22 is free to move toward and away from lock member 32 in directions 35, 37, permitting door 14 to be opened or closed. When in a first locked position, shown in FIG. 4, a second interactive portion or arm 39 of lock member 32 blocks movement of rod 22 preventing door 14 from being opened. Motor 30 then powers movement of lock member 32 to a second locked position shown in FIG. 5 wherein lock mechanism 20 and door 14 are cinched or drawn closer to cabinet 12.

Housing 28 is a mount that supports motor 30, lock member 32, and gear set 34 on door 14. Housing 28 includes a base 36 and a cover 38. Base 36 and cover 38 cooperate to define a rod-receiving opening 40 and an interior region 42 as shown in FIG. 2.

Figure 7:
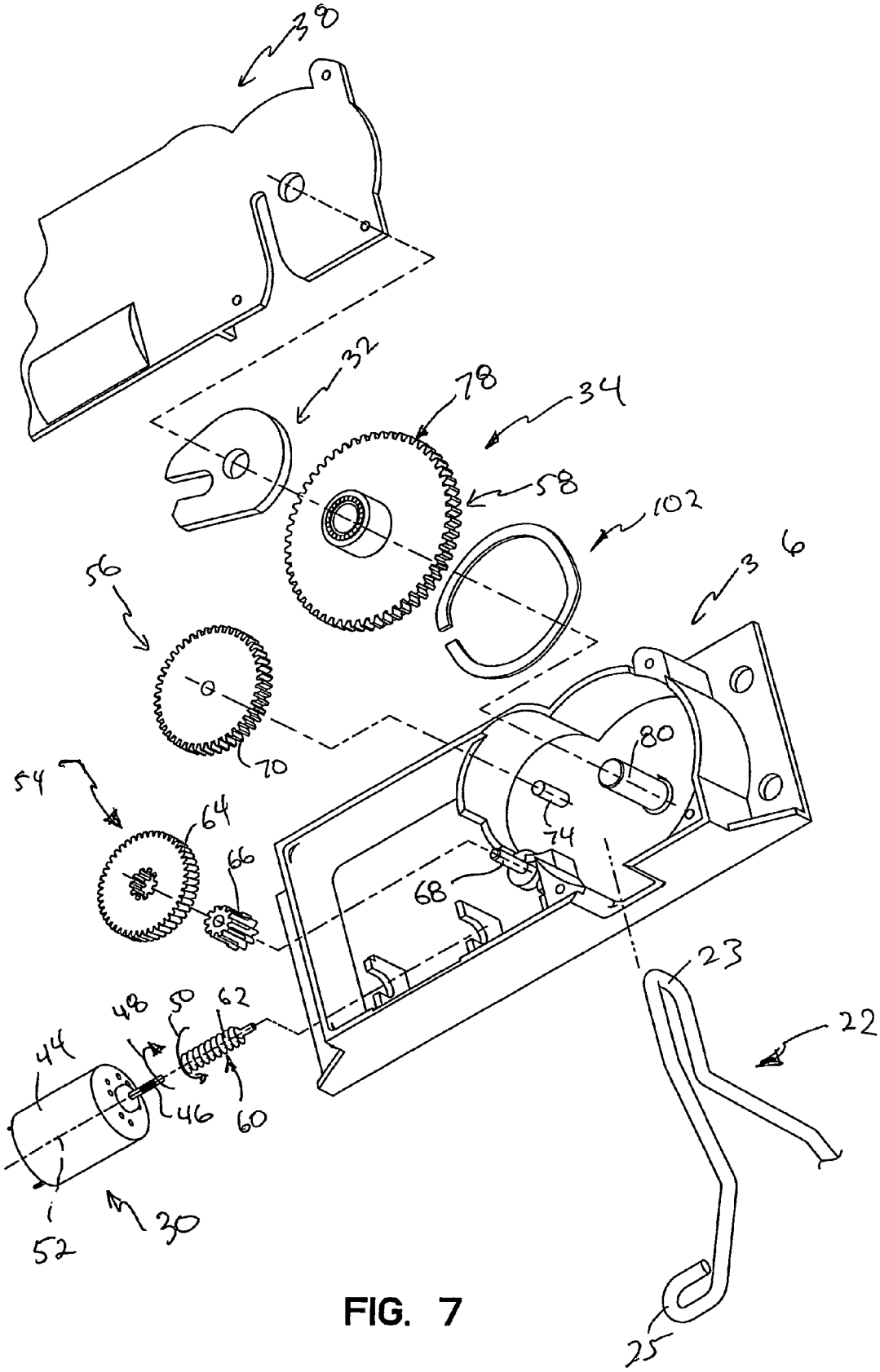
FIG. 7 is an exploded, perspective view of the rod and lock mechanism.

Motor 30, lock member 32, and gear set 34 are positioned in interior region 42 as shown, for example, in FIG. 2. Motor 30 includes an outer housing 44 and an output shaft 46 as shown in FIG. 7. Shaft 46 rotates in one of two directions 48, 50 about an axis 52. According to the preferred embodiment of the present disclosure, motor 30 is a 24 volt, model RS-380PH electric motor provided by Mabuchi Motor Co., Ltd.

As shown in FIG. 3, output shaft 46 transfers the output of motor 30 to gear set 34. Gear set 34 transforms the relatively high speed and low torque output of motor 30 to lock member 32 at a lower speed and higher torque. Lock member 32 and gear set 34 are coupled together so that rotation of gear set 34 causes lock member 32 to rotate. According to alternative embodiments of the present disclosure, other torque converters are provided such as planetary gear sets, double worm sets, and other torque converters known to those of ordinary skill in the art.

Gear set 34 includes first, second, and third gears 54, 56, 58. Shaft 46 of motor 30 includes a worm 60 having a thread 62 including a plurality turns. As shown in FIG. 7, first or worm gear 54 includes a plurality of outer and inner gear teeth 64, 66 and rotates relative to base 36 and cover 38 about a shaft 68 on base 36. Outer teeth 64 of first gear 54 mesh with worm 60. Similarly, second or spur gear 56 includes a plurality outer and inner teeth 70, 72 (shown in FIG. 6) and rotates relative to base 36 and cover 38 about a shaft 74. As shown in FIG. 7, outer teeth 70 of second gear 56 mesh with inner teeth 66 of first gear 54. Similarly, third or spur gear 58 includes a plurality outer teeth 78 and rotates relative to base 36 and cover 38 about a shaft 80. Outer teeth 78 of third gear 58 mesh with inner teeth 72 of second gear 56. The transfer of rotation from worm 60 and inner teeth 66, 72 to outer teeth 64, 70, 78 increases the torque and reduces the speed provided by motor 30.

Third gear 58 and lock member 32 cooperate to define a lost-motion coupling or mechanism that permits rotational movement of third gear 58 relative to lock member 32. Because of this lost-motion, lock member 32 can rotate on shaft 80 without shaft 46 of motor 30 rotating or motor 30 being energized. Additionally, motor 30 can rotate shaft 46 and gear set 34 without rotating lock member 32.

According to the preferred embodiment of the present disclosure, third gear or first ratchet/interactive member 58 and lock member or second ratchet/interactive member 32 cooperate to define a ratchet mechanism 81 that provides the lost motion coupling or mechanism. Thus, a lost motion coupling or mechanism (ratchet mechanism 81) is provided between a driver (motor 30) and locking first and second interactive members (looped portion 23 of rod 22 and arm 39 of lock member 32) that lock together two components (door 14 and cabinet 12). According to alternative embodiments of the present disclosure, other lost motion couplings or mechanisms are provided such a radial clutch with teeth, a radial clutch with a spring, or other lost motion couplings known to those of ordinary skill in the art.

Ratchet mechanism 81 includes complementary axially extending ratchet teeth 82, 84 on third gear 58 and lock member 32 that permits third gear 58 to rotate relative to lock member 32 in direction 88, but blocks relative movement of third gear 58 and lock member 32 in opposite direction 86. Ratchet teeth 82, 84 include ramp portions that facilitate relative movement between lock member 32 and third gear 58 and abutment portions that facilitate movement of lock member 32 and third gear 58 together.

Figure 4:
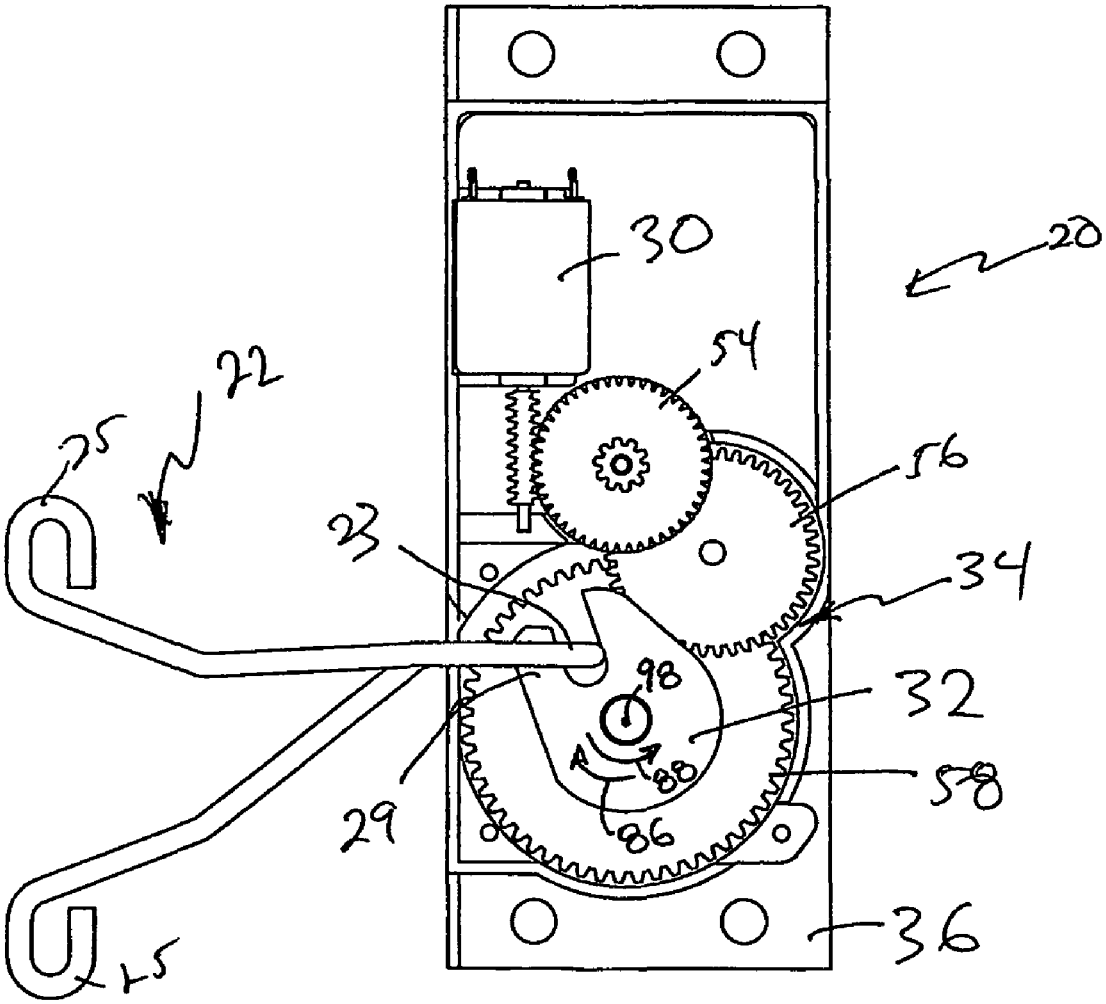
FIG. 4 is a view similar to FIG. 3 showing the rod in a first locked position relative to the C-shaped lock member.
Figure 5:
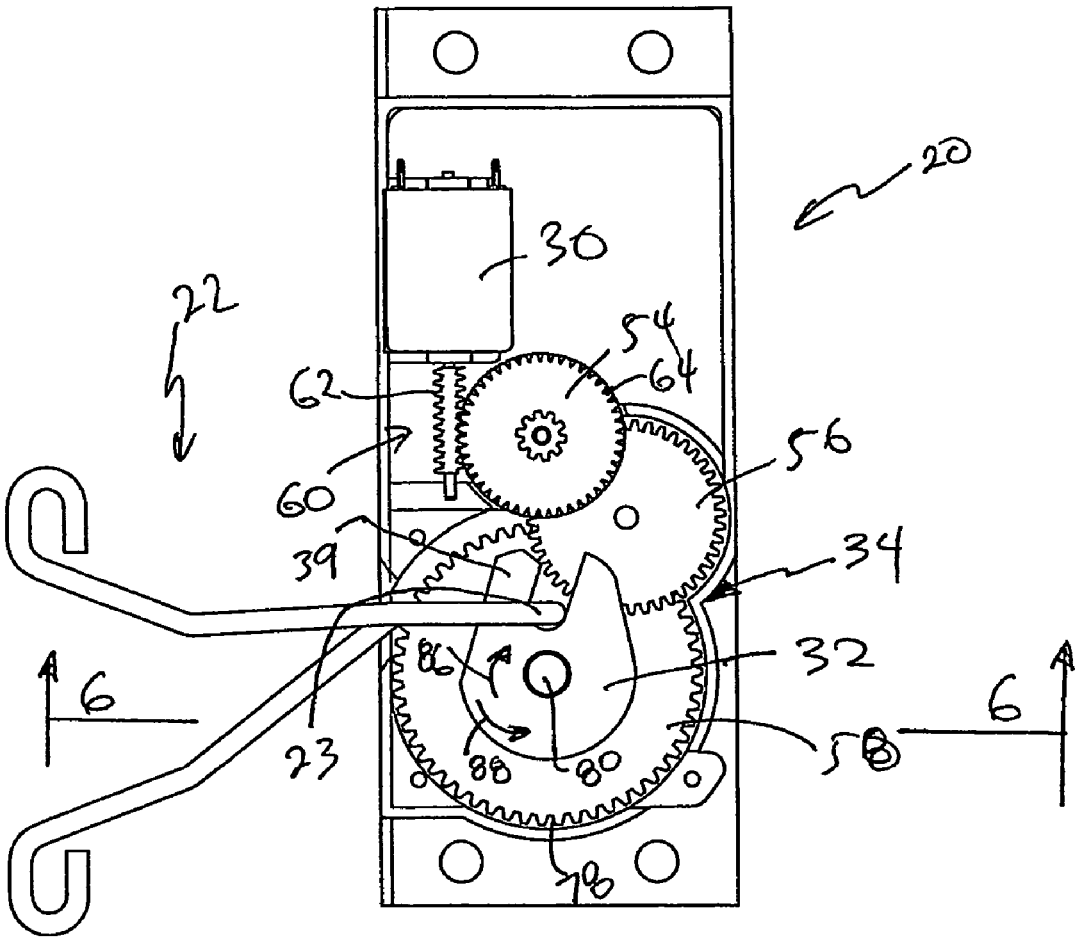
FIG. 5 is a view similar to FIG. 3 showing the rod in a second locked position relative to the C-shaped lock member.
Figure 6:
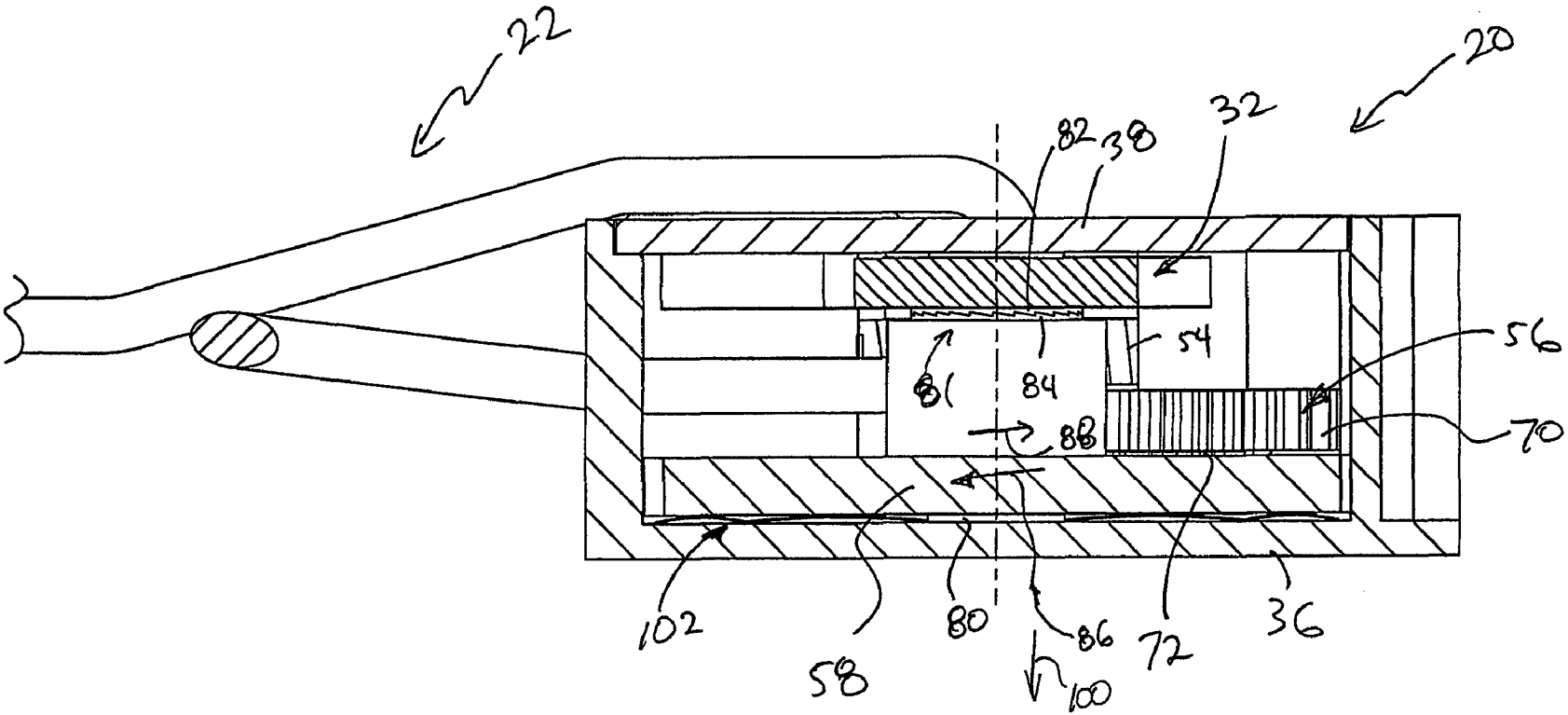
FIG. 6 is a cross-sectional view taken along line 6-6 of FIG. 5 showing the C-shaped lock member and the gear set cooperating to define a ratchet mechanism.

During movement of lock member 32 between the unlocked position, shown in FIG. 3, and the first locked position, shown in FIG. 4, motor 30 is not energized and lock member 32 rotates in direction 86 about axis of rotation 98. During this movement, shaft 46 of motor 30 does not rotate and blocks rotation of third gear 58. Because lock member 32 is rotating and third gear 58 is not rotating, the ramp portions of lock member 32 ride over the ramp portions of third gear 58. To facilitate this movement, third gear 58 is permitted to slide down shaft 80 in direction 100 against the bias of a wave washer or biasing member/spring 102 as shown in FIG. 6. According to alternative embodiments of the present disclosure, other biasing members are provided such as a compression spring, flexible tabs defining the ratchet teeth, a Bellville washer, polymeric elastomer, beam spring incorporated into the base, or other biasing members known to those of ordinary skill in the art.

Ratchet teeth 82, 84 permit lock member 32 to be pushed toward the first locked position by rod 22 without having to rotate gear set 34 or shaft 46 of motor 30. According to alternative embodiments of the present disclosure, other ratchet mechanisms are provided such as those disclosed in U.S. Pat. No. 6,325,233 to Harris; RE037,776 to Foltz; U.S. Pat. No. 6,179,148 to Harris; U.S. Pat. No. 5,110,003 to MacWilliams, the disclosures of which are expressly incorporated by reference herein. According to another alternative embodiment, the ratchet teeth may extend radially inwardly and outwardly rather than axially.

To fully compress the seal positioned between door 14 and cabinet 12, lock 18 cinches or tightens door 14 further closed. The control system of lock 18 includes a limit switch (not shown). When lock member 32 rotates through a predetermined angle, the limit switch moves between opened and closed positions. The control system detects this movement and provides power to motor 30. After rod 22 moves lock member 32 through a predetermined angle, motor 30 begins to turn shaft 46. Shaft 46 turns gear set 34. Third gear 58 rotates lock member 32 in direction 86 to pull lock member 22 to the second locked position shown in FIG. 5. This movement causes the seal to be further compressed. During this movement, the abutment portions of third gear 58 and lock member 32 abut each other to block relative movement of third gear 58 and lock member 32 so that third gear 58 and lock member 32 rotate together.

The control system is configured to stop motor 30 when the seal is adequately compressed. As motor 30 rotates lock member 32 in direction 86, the seal compresses and provides increasing resistance to further movement. As the resistance to movement increases, motor 30 draws additional electric current. The control system monitors the electric current drawn by motor 30 and shuts off the voltage to motor 30 when a predetermined current draw is reached. To determine the predetermined current draw, the current drawn by motor 30 is measured and recorded when the seal is adequately compressed. This measured current draw is then programmed into the control system for use in determining when to stop motor 30 from rotating.

To open door 14 of vending machine 10, a user presents a token, remote key, or key fob in the vicinity of the IR sensor (not shown) or opening (not shown) in cabinet 12 piping the IR signal to the optical sensor. If the control system determines that the token, remote key, or key fob is authorized to access vending machine 10, the control system instructs motor 30 to rotate shaft 46 in the opposite direction. Shaft 46 then rotates gear set 34. In particular, third gear 58 rotates lock member 32 in direction 88. During this rotation, spring 102 presses the ramp portions of ratchet teeth 82, 84 together to hamper the ramp portions from sliding over each other. During rotation, lock member 32 contacts the limit switch and moves it between the opened and closed position. The control system detects this movement and continues to power motor 30 for a predetermined period of time to move lock member 32 to the unlocked position as shown in FIG. 3. Once the predetermined time expires, the control system cuts the voltage supply to motor 30. Because lock member 32 is in the unlocked position and rod 22 is free to be withdrawn, door 14 can be opened. If lock member 32 reaches the unlocked position before the time expires, the ramp portions of teeth 82, 84 ride over each other so that lock member 32 ceases further rotation as motor 30 continues to rotate gear set 34. For example, according to one embodiment, arm 39 of lock member 32 strikes a stop on cover 38 or the limit switch which blocks further rotation of lock member 32 while third gear 58 continues to rotate.

Because of ratchet mechanism 81, precise alignment of lock member 32 relative to third gear 34 is not necessary. Regardless of which ratchet teeth 84 of lock member 32 align with which ratchet teeth 82 of third gear 58, lock 18 will properly couple and uncouple rod 22. Thus, if third gear 58 rotates an extra 180° or any other amount after lock member 32 has reached the unlocked position shown in FIG. 3, ratchet teeth 82, 84 will align and permit coupling and uncoupling of rod 22.

Unless otherwise stated herein, the figures are proportional. Although the invention has been described in detail with reference to a certain illustrated embodiment, variations and modifications exist within the scope and spirit of the present invention as described and defined in the following claims.

What is claimed is:

1. A vending machine configured to retain objects for distribution, the vending machine comprising a cabinet defining an interior region sized to receive the objects for distribution, a door coupled to the cabinet to move between an opened position permitting access to the interior region of the cabinet and a closed position blocking access to the interior region of the cabinet, at least one of the cabinet and door having an opening sized to permit distribution of the objects while the door is in the closed position, and a lock configured to move between a locked position blocking movement of the door from the closed position and an unlocked position permitting movement of the door from the closed position, the lock including a housing, a lock member supported by the housing, a motor configured to power movement of the lock member, and a ratchet mechanism positioned between the lock member and the motor to transfer force from the motor to the lock member, wherein the ratchet mechanism includes a first ratchet member operatively coupled to the lock member and a second ratchet member operably coupled to the motor, the first and second ratchet members rotating relative to one another about an axis of rotation during at least a portion of the movement of the lock to the locked position, the first and second ratchet members each includes a plurality of teeth that engage each other to transfer force in a first direction about the axis of rotation during at least a portion of the movement of the lock toward the unlocked position and slip over each other in an opposite second direction about the axis of rotation during at least a portion of the movement of the lock toward the locked position.

2. The vending machine of claim 1, wherein the first ratchet member transfers force from the motor to the lock member during movement of the lock from the locked position to the unlocked position.

3. The vending machine of claim 2, wherein the first ratchet member transfers force from the motor to the lock member during at least a portion of the movement of the lock from the unlocked position to the locked position.

4. The vending machine of claim 1, further comprising a gear set positioned between the ratchet mechanism and the motor.

5. The vending machine of claim 4, wherein the gear set includes a plurality of spur gears.

6. The vending machine of claim 4, wherein the gear set includes a worm.

7. The vending machine of claim 1, wherein the plurality of teeth are ramped.

8. The vending machine of claim 1, where in the lock member directly contacts a portion of at least one of the door and the cabinet to block movement of the door from the closed position.

9. A vending machine configured to retain objects for distribution, the vending machine comprising a cabinet defining an interior region sized to receive the objects for distribution, a door coupled to the cabinet to move between an opened position permitting access to the interior region of the cabinet and a closed position blocking access to the interior region of the cabinet, at least one of the cabinet and door having an opening sized to permit distribution of the objects while the door is in the closed position, and a lock configured to move between a locked position blocking movement of the door from the closed position and an unlocked position permitting movement of the door from the closed position, the lock including a housing, a lock member supported by the housing, a motor configured to power movement of the lock member, and a ratchet mechanism positioned between the lock member and the motor to transfer force from the motor to the lock member, the ratchet mechanism including a first ratchet member operatively coupled to the lock member and a second ratchet member operably coupled to the motor, the first and second ratchet members rotating relative to one another about an axis of rotation during at least a portion of the movement of the lock to the locked position, wherein the first ratchet member includes a first plurality of teeth spaced apart from the axis of rotation by a first distance, and a second plurality of teeth spaced apart from the axis of rotation by a second distance that is greater than the first distance.

10. The vending machine of claim 9, wherein the first ratchet member rotates about an axis of rotation and the second ratchet member rotates about the axis of rotation about which the first ratchet rotates.

11. The vending machine of claim 9, wherein the first ratchet rotates in a first direction and the second ratchet member rotates in the first direction during at least a portion of the movement of the door to the closed position.

12. The vending machine of claim 9, wherein the first and second ratchet members rotate relative to one another during a first portion of the movement of the door to the closed position and rotate with each other in the same direction during a second portion of the movement of the door to the closed position.

13. The vending machine of claim 9, wherein the first plurality of teeth extend in an axial direction and the second plurality of teeth extend in a radial direction.

* * * * *